United States Patent [19]

Kinoshita

[11] Patent Number: 4,630,559

[45] Date of Patent: Dec. 23, 1986

[54] THREAD CUTTING MECHANISM IN LOCK STITCH SEWING MACHINE

[75] Inventor: Tomoaki Kinoshita, Kanagawa, Japan

[73] Assignee: Tokyo Juki Industrial Co., Ltd., Chofu, Japan

[21] Appl. No.: 666,485

[22] Filed: Oct. 30, 1984

[51] Int. Cl.[4] ..... D05B 65/02

[52] U.S. Cl. ..... 112/291

[58] Field of Search ..... 112/288, 291, 293

[56] References Cited

U.S. PATENT DOCUMENTS

| | | | |
|---|---|---|---|
| 2,376,417 | 5/1945 | Chudner | 112/291 |
| 3,524,420 | 8/1970 | Peschke | 112/293 |
| 4,523,535 | 6/1985 | Blackburn | 112/288 |

FOREIGN PATENT DOCUMENTS

| | | | |
|---|---|---|---|
| 2015757 | 10/1971 | Fed. Rep. of Germany | 112/291 |
| 58-11238 | 3/1983 | Japan . | |
| 58-11239 | 3/1983 | Japan . | |
| 357299 | 12/1972 | U.S.S.R. | 112/291 |

*Primary Examiner*—Werner H. Schroeder
*Assistant Examiner*—Andrew M. Falik
*Attorney, Agent, or Firm*—Yount & Tarolli

[57] ABSTRACT

A thread cutting mechanism for a lock stitch sewing machine which comprises a stationary blade, a reciprocally movable blade, operation means for moving the movable blade reciprocally and adjusting means for adjusting the reciprocal movement distance of the movable blade so as to vary the operative position with the initial position maintained constant. The movable blade includes a thread handling portion, a thread cutting knife portion, a thread arresting portion and a thread guide portion.

1 Claim, 5 Drawing Figures

THREAD CUTTING MECHANISM IN LOCK STITCH SEWING MACHINE

BACKGROUND OF THE INVENTION

This invention relates to a novel and improved thread cutting mechanism in a lock stitch sewing machine in which a stationary blade fixedly secured to the machine framework below a throat plate and a reciprocally movable blade cooperate with each other in cutting an indefinite length of thread connected to a workpiece being sewn and more particularly, to improvements in and relating to an operation device for the thread cutting mechanism so as to perform positive thread cutting.

Before in the conventional thread cutting means illustrated in FIGS. 2(A)-(D) the reciprocal or swinging blade 2 pivotable about the vertical shaft 1 is formed at its leading edge with a thread handling portion 2*a*. This portion separates the upper and lower threads Ta and U connected to the workpiece being sewn from the upper thread portion Tb connected to the sewing needle during the counter clockwise movement of the blade from the FIG. 2(A) to the FIG. 2 (B) position. At its trailing edge the blade is formed with a thread arresting portion 2*b* where said threads Ta and U are arrested when the clock-wise blade movement from the FIG. 2(B) to the FIG. 2(C) position occurs. At the outer end face the blade is formed with a knife portion 2(*c*) where said arrested threads Ta and U are cut by the relative movement between said knife portion and the fixed blade 3.

During the counter clockwise reciprocal movement of the blade the upper and lower threads Ta and U are initially engaged by the portion 2*a* then frictionally move along the arcuate guide portion 2*d* until they slide off to a position adjacent said thread arresting portion. With thick or stiff threads however there is sufficient tension on said threads to create a high amount of friction between them and the trailing edge of the portion 2*d* such that the yarn is not released therefrom as shown in FIG. 2(D). They thus can't be cut by said relative blade movement when the movable blade 2 assumes the FIG. 2(C) position.

SUMMARY OF THE INVENTION

Therefore, the purpose of the present invention is to eliminate the above-mentioned drawbacks inherent in the conventional thread cutting mechanism.

According to the present invention, there has been provided a thread cutting mechanism in a lock stitch sewing machine which essentially comprises a stationary blade fixedly secured to the framework of said sewing machine, a movable blade for reciprocal movement between initial and operative positions and having a thread handling portion, a knife portion, a thead arresting portion and a thread guide portion for cutting threads connected to a workpiece in cooperation with said stationary blade, operation means operatively connected to said movable blade to move the blade reciprocally and adjusting means operatively associated with said operation means for adjusting the distance of the reciprocal movement of the blade so as to vary said operative position with said initial position maintained constant.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the scope of the same in any way.

DETAILED DESCRIPTION OF THE PREFERRED EMBODIMENT

Figure 1:
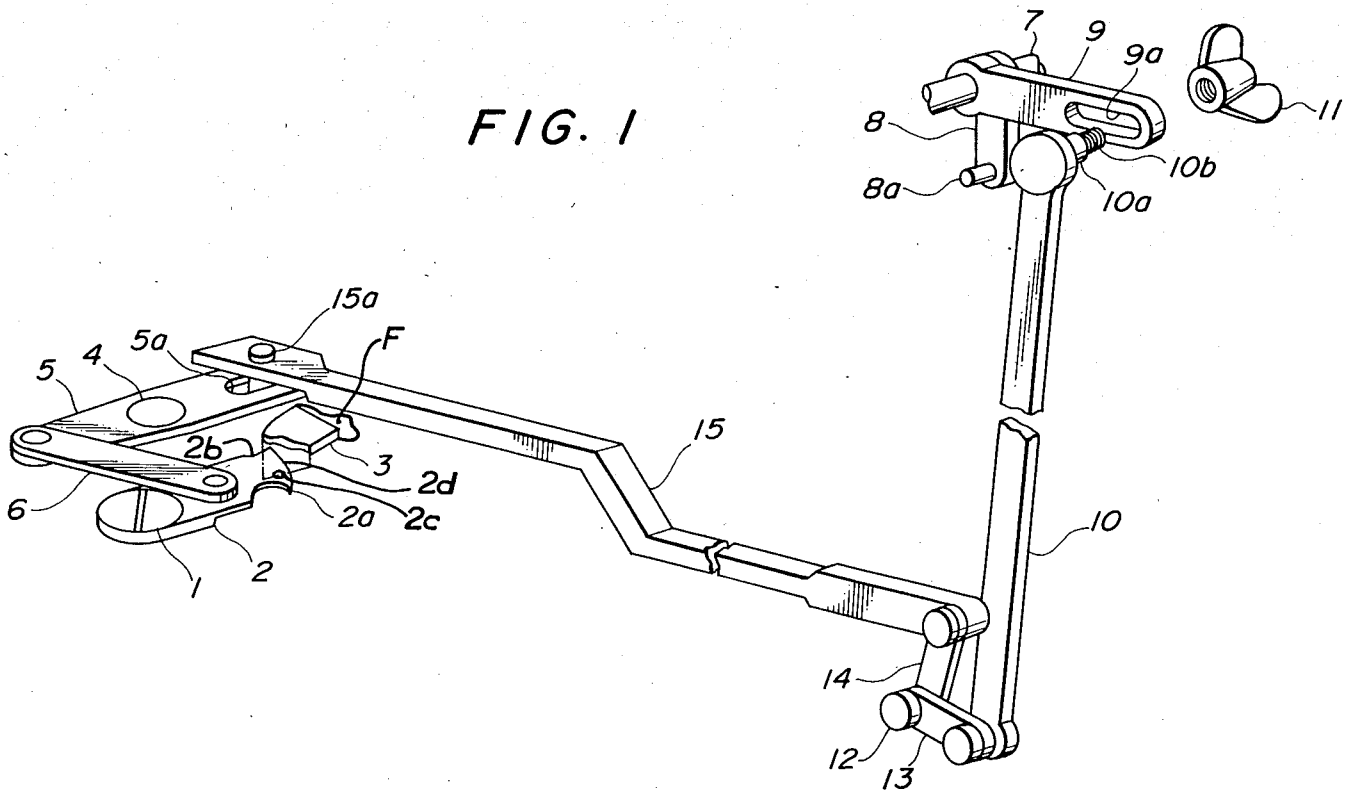
FIG. 1 is a perspective view of the thread cutting mechanism of a lock stitch sewing machine in which the present invention is incorporated.

The present invention will be now described referring to the accompanying drawings in which the movable and stationary blades are assigned thereto the same numerals used for the corresponding parts of the conventional thread cutting mechanism described hereinabove.

A vertical support shaft 1 is disposed below the throat plate 17 in FIG. 3 of the lock stitch sewing machine and a horizontal movable blade 2 is supported at one end on the support shaft 1 for rotation about the latter. The movable blade 2 consists of a thread handling portion 2*a*, a thread arresting portion 2*b*, a knife portion 2*c* and a thread guide portion 2*d* which are identical with the corresponding portions of the conventional movable blade with respect to construction and operation. A stationary blade 3 is fixedly secured to the framework "F" of the sewing machine above the path of the blade 2 for engaging the knife portion 2*c* on the movable blade 2 as the latter rotates. A horizontal operation plate 5 is rotatably supported in an intermediate position between the opposite ends thereof on a vertical shaft 4 and bifurcated at one end 5*a*. A link 6 is pivoted at the opposite ends thereof to an intermediate position between the opposite ends of the movable blade 2 and to the other end of the operation plate 5.

Reference numeral 7 denotes a drive member support shaft supported inwardly of the top frame of the sewing machine framework (not shown) and has the horizontal axis extending at right angles to the horizontal axis of the main shaft (not shown) of the machine. A drive member 8 is movably supported at one or the upper end on the support shaft for both rotation about and axial movement along the support shaft 7 and has a pin 8*a* extending laterally at the lower end. The drive member 8 is normally spaced from a known member such as a thread cutting cam adapted to rotate in response to the rotation of the main shaft as shown in Japanese Patent Publication No. 45349/1974 and moves axially along the support shaft 7 in response to the energization of an operation means such as an electromagnet to engage the thread cutting cam at the pin 8*a*. The drive member 8 rotates or rocks about the support shaft 7 as the thread cutting cam makes one complete rotation so as to vary the position of its cam face. An operation member 9 is rotatably supported at the base end on the support shaft 7 for rocking about the shaft together with the drive member 8 and is formed at the leading end with a slot 9*a* at right angles to the axis of the support shaft 7. The operation member 9 rocks about the support shaft 7 so as to move the leading end upwardly and downwardly in unison with the rocking of the drive member 8 about the support shaft 7. A connector arm 10 has at the upper end a laterally extending shoulder 10*a* for engaging in the slot 9*a* and a threaded portion 10*b* coaxial and integral with the shoulder 10*a*. When the shoulder 10*a* is engaged in the slot 9*a* and a nut 11 is screwed onto the threaded portion 10*b*, the connector arm 10 can be held in position with respect to the operation member 9 with a washer (not shown) interposed between the member 9 and nut 11.

A horizontal stub shaft 12 is supported on the frame (not shown) at the lower end of one leg (not shown) of the sewing machine for rotation about its own axis parallel to the axis of the supported shaft 7. A first link 13 is rotatably connected at one end to the shaft 12 and at the other end to the lower end of the connector arm 10. A second link 14 is fixedly secured at the lower end to the shaft 12. A horizontal connector bar 15 has at one end a downwardly extending pin 15*a* engaging in the bifurcated end 5*a* of the operation member 5 and is rotatably connected at the other to the upper end of the second link 14.

Figure 3:
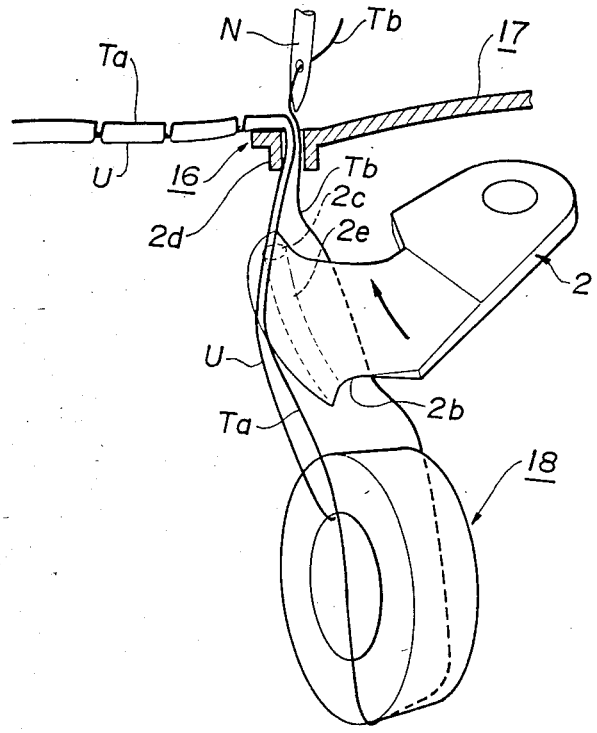
FIG. 3 is a perspective view in partial section showing the function of the semicircular thread guide of the thread cutting mechanism.

A semicircular thread guide 16 is secured to the throat plate 17 of the sewing machine and has a center opening 16*a* through which the upper thread portions Ta, Tb and lower thread U are guided as more clearly shown in FIG. 3. Reference numeral 18 denotes a conventional rotatable shuttle which is provided under the machine table (not shown) below the movable blade 2 in the conventional manner and the shuttle includes a bobbin (not shown) about which the lower thread U is wound and a hook (not shown). The shuttle 18 is rotated by the needle drive motor (not shown) to cause the hook to entangle the upper and lower threads with each other and the entangled threads are passed through the opening 16*a* in the throat plate 17 as the movable blade 2 rotates. A hole 2*c* comprises a knife means which is further defined by a channel means 2*e* which extends across a lower portion of the movable blade.

Figure 2A:
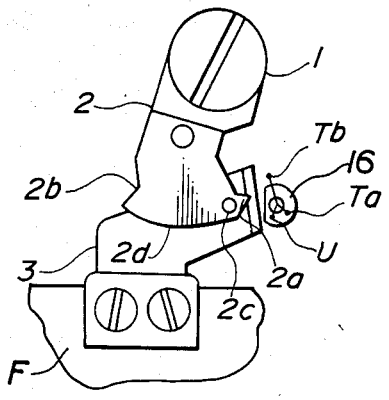
FIGS. 2(A)-2(D) show the sequence of operations of the movable blade in relationship to the fixed blade to effect thread cutting, FIGS. 2(A) and 2(B) disclose a prior art blade.
Figure 2B:
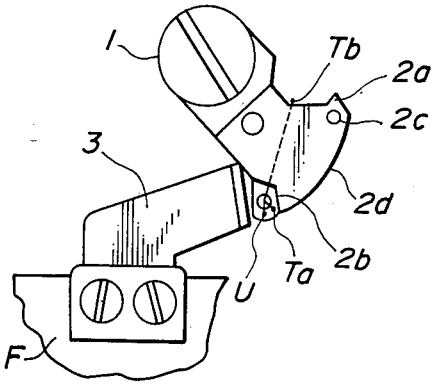
Figure 2C:
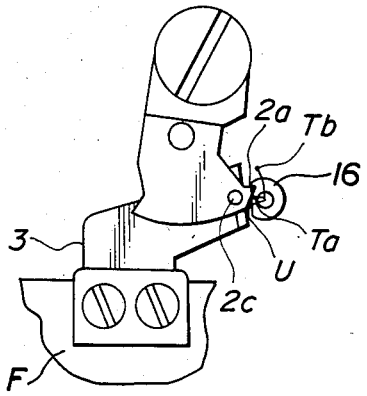
Figure 2D:
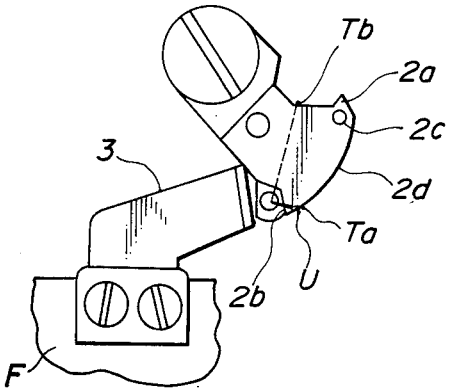

The position of the movable blade 2 is an intermediate position between the positions of the blade 2 as shown in FIGS. 2A and 2B, respectively. In the position of the movable blade 2 shown in FIG. 3, the upper and lower threads Ta and U are tensioned by the thread guide portion 2*d* of the blade 2 and then move into the thread arresting portion 2*b* of the movable blade 2 as the blade 2 is further rotated in the arrow direction as shown in FIG. 3.

Figure 4A:
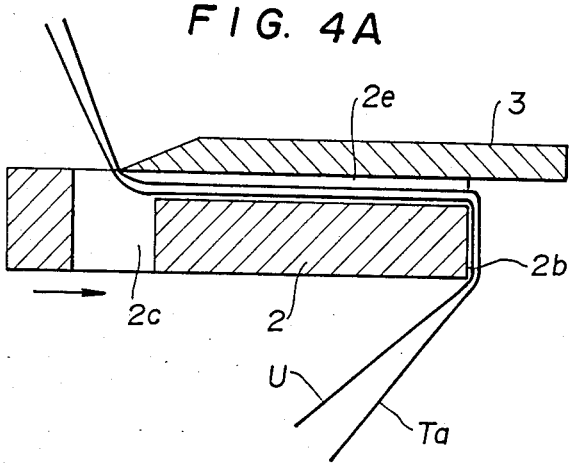
FIG. 4A is a sectional view showing the relationship between the movable and stationary blades prior to the cutting of the threads.
Figure 4B:
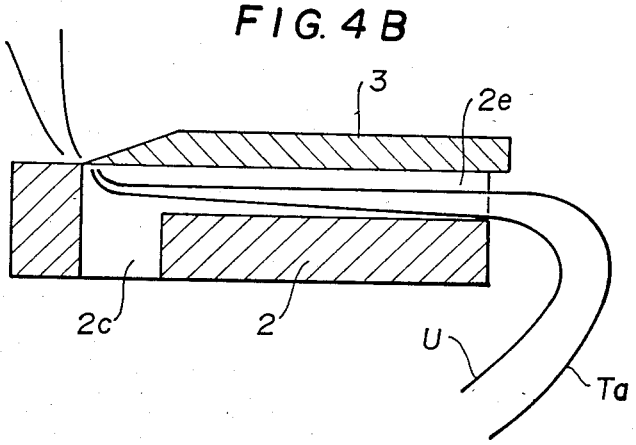
FIG. 4B is a sectional view showing the relationship between the movable and stationary blades immediately after the cutting of the threads.

FIG. 4A shows the relationship between the movable blade 2 and stationary blade 3 before the upper and lower threads Ta and U are cut by the blades and when the movable blade 2 further rotates from the position of the blade 2 shown in FIG. 4A to the position of the movable blade 2 shown in FIG. 4B, the upper and lower threads are cut. In FIG. 4B, the upper and lower threads Ta and U are shown in the condition immediately after the cutting thereof.

When an operation means such as the electromagnet, is energized at the completion of formation of one seam, the drive member 8 moves axially along the support shaft 7 until the pin 8*a* on the member 8 engages the thread cutting cam. As the thread cutting cam makes one complete rotation to vary the position of its cam face with the pin 8*a* engaging the cam, the drive member 8 rocks about the support shaft 7. In response to the rocking of the drive member 8, the operation member 9 rocks about the support shaft 7 to move the connector arm 10 upwardly and downwardly so as to cause the connector bar 15 to rock horizontally through the first and second links 13 and 14. The operation plate 5 having the pin 15*a* on the connector bar 15 engaged in the bifurcated end 5*a* of the plate rocks about the support shaft 4 to cause the movable blade 2 to rotate reciprocally about the support shaft 1 through the connector plate 6 whereby the thread cutting mechanism performs thread cutting in the manner mentioned hereinabove.

By varying the position of the connector arm 10 with respect to the slot 9*a* in the operation member 9, the distance between the axes of the support shaft 7 and connector arm 10 is varied accordingly. When the distance between the axes of the shaft 7 and arm 10 is reduced, the amplitude of the vertical movement of the connector arm 10 is reduced resulting in shortening of the reciprocal movement stroke of the movable blade 2. On the other hand, when the distance between the axes of the support shaft 7 and connector arm 10 is increased, the amplitude of the vertical movement of the connector arm 10 is increased resulting in extension of the reciprocal movement stroke of the movable blade 2. Thus, when the sewing machine employs an indefinite length of thick or stiff thread, the connector arm 10 is positioned so as to increase the above-mentioned axis to axis distance. Even when the position of the connector arm 10 is varied relative to the slot 9*a* in the operation member 9, since the first and second links 13 and 14 scarcely rotate, the initial position of the movable blade 2 will not vary substantially.

In the illustrated embodiment, although the movable blade 2 is rotatable about a fixed axis, it is also contemplated that the movable blade moves reciprocally in a straight line to arrest and cut an indefinite length of sewing thread.

And in the illustrated embodiment, although the thread cutting means moves reciprocally in response to the operation of the mechanical drive means, it is also contemplated that the thread cutting means is moved reciprocally by drive means such as an electromagnet or air cylinder and the reciprocal movement stroke is adjusted or varied by varying the movement stroke of the operation member such as the armature of the electromagnet or the like by varying the position of a stopper.

As clear from the foregoing description, according to the present invention, by the provision of the adjusting means in association with the operation means which adjusting means allows the reciprocal movement distance of the movable blade to the adjusted so as to vary the operative position of the blade with the initial position of the blade maintained constant, the reciprocal movement stroke of the movable blade can be adjusted and thus, when the sewing machine employes an indefinite length of thick or hard thread, for example, the stroke is extended so that the thread may come off the guide portion 2*d* of the blade 2 to the position in which the thread positively faces the path of the thread arresting portion 2*b* of the blade to be positvely arrested and cut by the blade whereby the length of the end portion of the thread connected to a workpiece being sewn is maintained constant. As a result, the quality of the sewn product is improved and troublesome manual cutting of the thread end portion by the operator is eliminated resulting in enhancement of sewing operation efficiency.

While only one embodiment of the invention has been shown and described in detail, it will be understood that the same is for illustration purpose only, and not to be taken as a definition of the invention, reference being had for this purpose to the appended claim.

What is claimed is:

1. A thread cutting mechanism for a lock stitch sewing machine comprising;

a stationary blade fixedly secured to the framework of said sewing machine;

a movable blade for reciprocal movement between initial and operative positions and having a thread handling portion formed at the leading edge of said movable blade for initially engaging threads attached to a work piece being sewn as the blade moves from an initial to an operative position and passing said threads to a guide portion formed at the outer edge of the blade whereby said threads when said blade moves to an operative position are caused to slide off said guide portion and lie adjacent a thread arresting portion of said blade, whereby said arresting portion traps the threads upon the return reciprocal movement of the blade to its initial position to cause said threads to be cut by the relative movement between said movable and stationary blades;

operation means operatively connected to said movable blade for causing the movable blade to move reciprocally when said operation means is actuated wherein the improvement comprises adjusting means operatively associated with said operation means for adjusting the distance the blade reciprocates between said initial and operative positions to ensure that said threads will slide off said guide portion upon said return movement of the blade to its initial position.

* * * * *